US011718491B2

(12) United States Patent
Araishi

(10) Patent No.: US 11,718,491 B2
(45) Date of Patent: Aug. 8, 2023

(54) CONVEYANCE DEVICE WITH ACCESS COVER CAPABLE OF EXPOSING INTERNAL STRUCTURE

(71) Applicant: KYOCERA Document Solutions Inc., Osaka (JP)

(72) Inventor: Kuniaki Araishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/719,105

(22) Filed: Apr. 12, 2022

(65) Prior Publication Data

US 2022/0340384 A1 Oct. 27, 2022

(30) Foreign Application Priority Data

Apr. 23, 2021 (JP) ..... 2021-073048

(51) Int. Cl.
*B65H 5/02* (2006.01)
*G03G 21/16* (2006.01)
*B65H 29/16* (2006.01)

(52) U.S. Cl.
CPC ..... *B65H 5/021* (2013.01); *B65H 29/16* (2013.01); *G03G 21/1633* (2013.01); *B65H 2402/441* (2013.01); *B65H 2402/45* (2013.01); *B65H 2404/2693* (2013.01); *B65H 2601/321* (2013.01); *B65H 2601/324* (2013.01); *B65H 2801/06* (2013.01); *B65H 2801/27* (2013.01)

(58) Field of Classification Search
CPC ..... G03G 21/1633; G03G 2402/441; G03G 2402/45; B65H 2404/2615; B65H 2404/2693; B65H 5/021
See application file for complete search history.

(56) References Cited

U.S. PATENT DOCUMENTS 10,241,465 B2 * 3/2019 Naganuma ..... G03G 21/1633

FOREIGN PATENT DOCUMENTS

JP 2010-127997 A 6/2010

* cited by examiner

*Primary Examiner* — Jeremy R Severson
(74) *Attorney, Agent, or Firm* — IP Business Solutions, LLC

(57) ABSTRACT

A conveyance device includes a locking mechanism for an access cover. The locking mechanism includes a cooperating lever and a locking shaft attached to the cooperating lever. The locking shaft is slidable in an axial direction thereof between a locking position where the locking shaft engages in a locking groove of the access cover and a second unlocking position located lateral o the locking groove. When in the second unlocking position, the locking shaft engages with an engaged portion provided at part of a housing or at a fixed frame attached to the housing to constrain the cooperating lever against downward movement of a distal end of the cooperating lever. The locking mechanism further includes an operating member coupled to the locking shaft and including a holding portion capable of being held from outside the housing.

5 Claims, 13 Drawing Sheets

CONVEYANCE DEVICE WITH ACCESS COVER CAPABLE OF EXPOSING INTERNAL STRUCTURE

INCORPORATION BY REFERENCE

This application claims priority to Japanese Patent Application No. 2021-073048 filed on Apr. 23, 2021, the entire contents of which are incorporated by reference herein.

BACKGROUND

The present disclosure relates to a conveyance device that conveys a sheet conveyed from an image forming apparatus to a post-processing device.

There is known an image forming apparatus that includes: an access cover capable of pivotally moving about a fulcrum, which is a lower edge of an opening formed in a housing, and thus exposing the interior of the housing; and a locking mechanism for locking the access cover. The locking mechanism is designed so that when the access cover is closed, two hook members provided at an upper end of the access cover engage around a shaft provided at the inside of the image forming apparatus to lock the access cover. The hook members are operatively connected to a manual lever. When the manual lever is pulled up, the two hook members are disengaged from the shaft to unlock the access cover.

SUMMARY

A technique improved over the aforementioned technique is proposed as one aspect of the present disclosure.

A conveyance device according to an aspect of the present disclosure includes a conveyance unit, a housing, an access cover, and a locking mechanism. The conveyance unit is pivotally movable up and down about a horizontal axis and movable between a conveyance position where a sheet is horizontally conveyable and a maintenance position a predetermined amount pivotally moved down about the horizontal axis from the conveyance position. The housing contains the conveyance unit and has a maintenance opening which is formed in a side surface and through which the conveyance unit is accessible. The access cover is pivotally movable about a predetermined axis along an edge of the maintenance opening. When the conveyance unit is in the conveyance position, the locking mechanism locks the access cover against opening and closing movement. On the other hand, when the conveyance unit pivotally moves from the conveyance position to the maintenance position, the locking mechanism unlocks the access cover. Furthermore, the locking mechanism includes a locking groove, a cooperating lever, a lever supporting shaft, a locking shaft, and a biasing member. The locking groove is provided at an inner wall surface of the access cover. The cooperating lever has a root end facing the maintenance opening and a distal end located opposite to the maintenance opening. The lever supporting shaft extends in parallel with the predetermined axis and supports an intermediate portion of the cooperating lever located between the root end and the distal end of the cooperating lever to allow pivotal movement of the intermediate portion. The locking shaft is attached to the root end of the cooperating lever and extends in parallel with an inner surface of the access cover being in a closed position. The biasing member biases the cooperating lever, with the lever supporting shaft as a fulcrum, toward engagement of the locking shaft in the locking groove of the access cover being in the closed position. When the conveyance unit is in the conveyance position, the locking shaft is located in a locking position where the locking shaft engages in the locking groove. When the conveyance unit moves down from the conveyance position to the maintenance position, the distal end of the cooperating lever is pushed down by the conveyance unit to lift the root end of the cooperating lever and, thus, the locking shaft escapes upwardly out of the locking groove and moves to a first unlocking position. The locking shaft is supported by the cooperating lever slidably in an axial direction of the locking shaft between the locking position where the locking shaft engages in the locking groove and a second unlocking position located lateral to the locking groove. When in the second unlocking position, the locking shaft engages with an engaged portion provided at the housing to constrain the cooperating lever against downward movement of the distal end of the cooperating lever. The conveyance device further includes an operating member. The operating member is coupled to the locking shaft, includes a holding portion capable of being held from outside the housing, and is capable of moving the locking shaft through the holding portion between the locking position and the second unlocking position.

DETAILED DESCRIPTION

Hereinafter, a description will be given of a conveyance device according to embodiments of the present disclosure with reference to the drawings. However, the present disclosure is not limited to the following embodiments.

Embodiment

Figure 1:
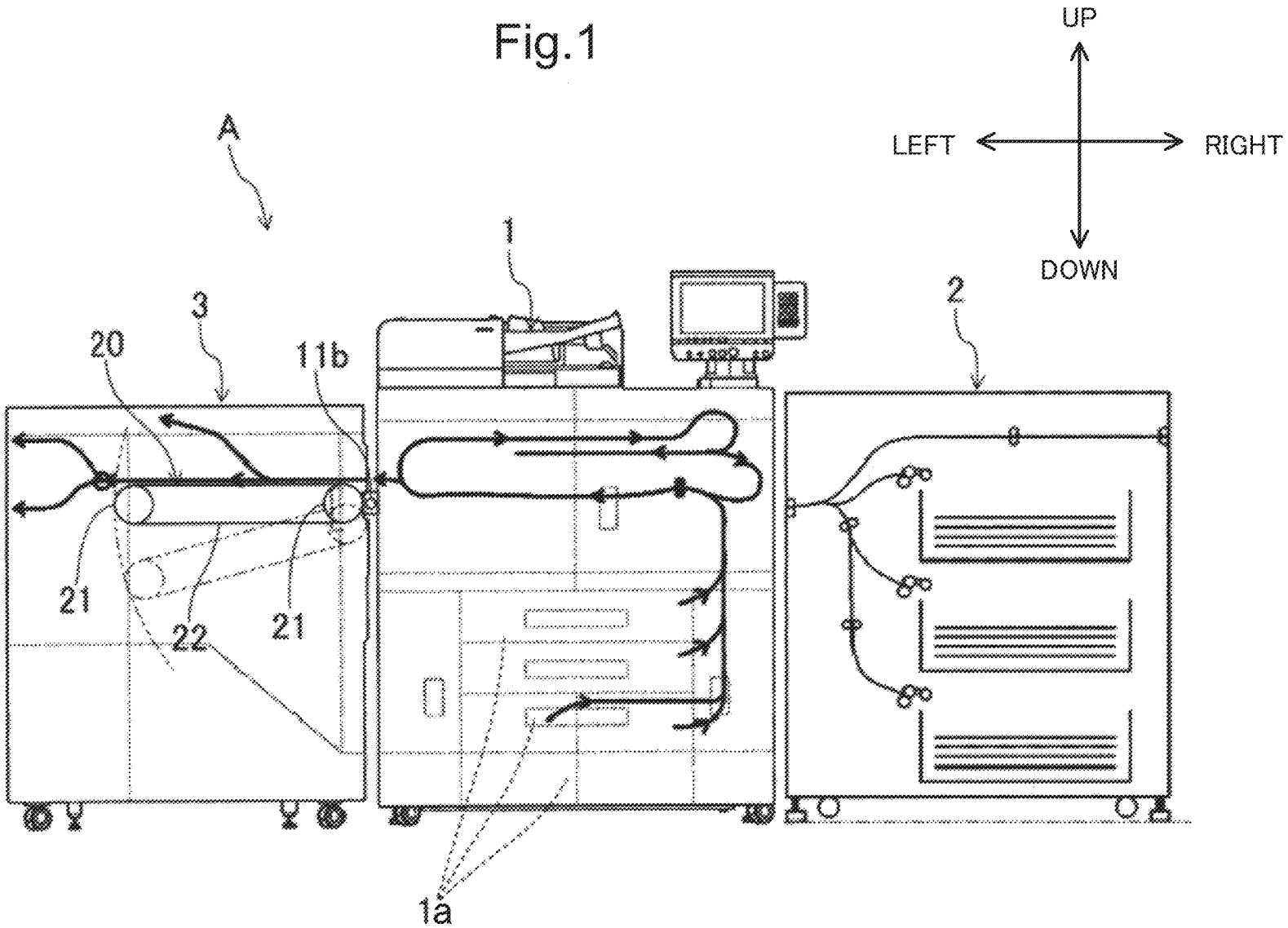
FIG. 1 is a schematic view of an image formation system including an intermediary conveyance device as an example of a conveyance device according to an embodiment.

FIG. 1 shows an image formation system A including an intermediary conveyance device 3 as an example of a conveyance device according to an embodiment.

Specifically, the image formation system A includes an image forming apparatus 1, a sheet feeder 2, and the above-mentioned intermediary conveyance device 3. In the following description, the directional terms "front", "rear", "left", and "right" follow the definitions of the directional axes shown in each of the figures.

The sheet feeder 2 is disposed to the right of the image forming apparatus 1 and feeds sheets to the image forming apparatus 1 in mass printing. The image forming apparatus 1 prints an image on a sheet fed from any one of sheet feed cassettes 1*a* loaded in a lower portion thereof or a sheet fed from the sheet feeder 2. The printing process that can be adopted in the image forming apparatus 1 is, for example, an electrophotographic process or an ink-jet process.

The intermediary conveyance device 3 is disposed to the left of the image forming apparatus 1, receives the printed sheet discharged from the image forming apparatus 1, and feeds it to a post-processing device (not shown) or so on. The intermediary conveyance device 3 contains a conveyance unit 20. The conveyance unit 20 forms a sheet conveyance path together with unshown conveyance members (for example, a conveying belt and a conveyance roller pair) disposed above the conveyance unit 20. The thick arrows in FIG. 1 show examples of sheet conveyance routes.

The conveyance unit 20 is contained in a housing of the intermediary conveyance device 3. The housing is constituted by a framing 10 (see FIG. 2) and an exterior cover (not shown) covering all the side surfaces of the framing 10.

Figure 2:
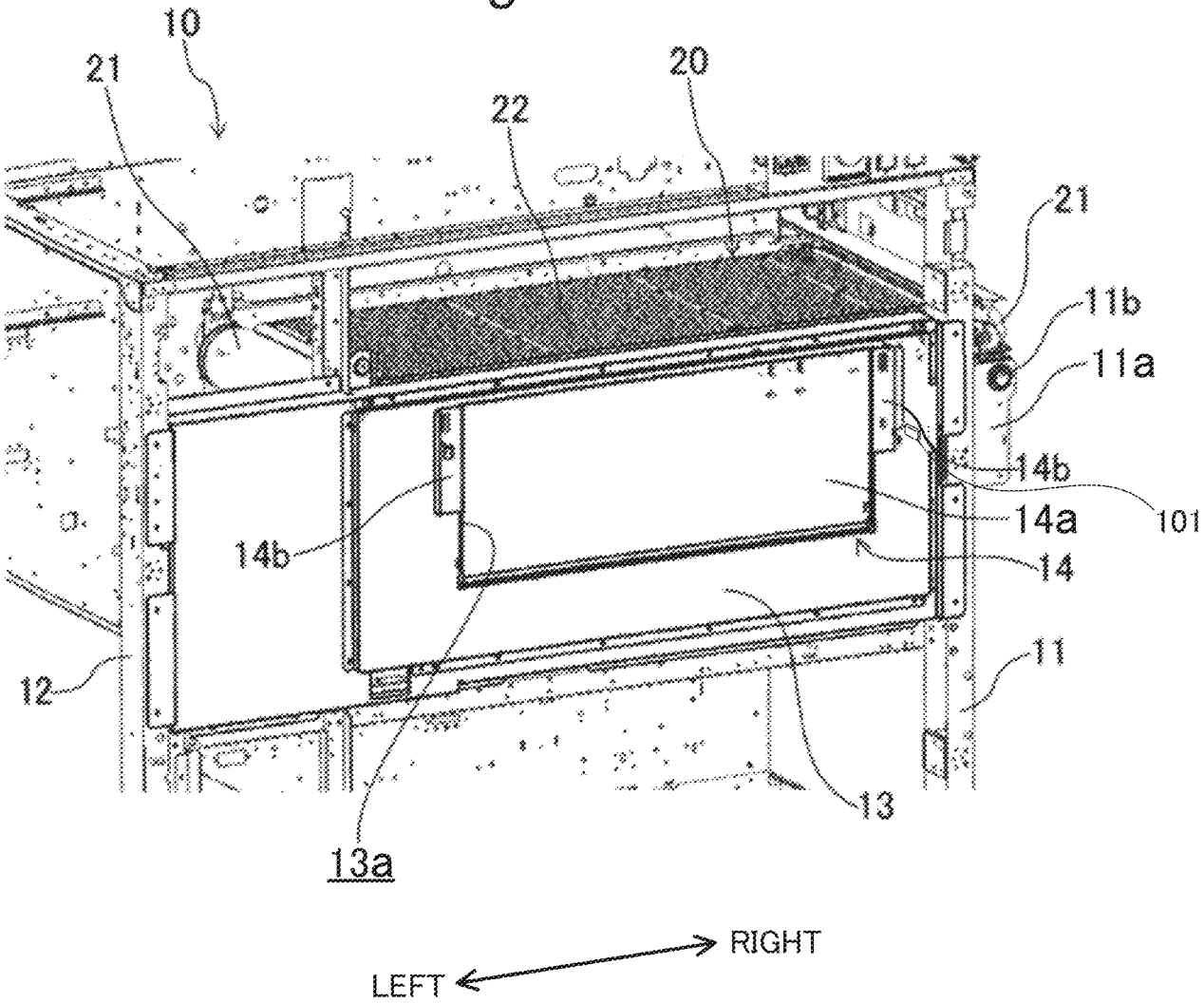
FIG. 2 is a perspective view showing an appearance of the intermediary conveyance device from which an exterior cover is removed and shows a state where an access cover is closed.

FIG. 2 is a perspective view showing an appearance of the intermediary conveyance device 3 being in a state where the exterior cover is removed from the housing. The framing 10 of the housing includes right and left post members 11, 12 and a sheet-metal member covering the front sides of the right and left post members 11, 12 located at the front of the framing 10. A front frame sheet metal 13 is attached to the sheet-metal member to cover the front side of the conveyance unit 20.

The front frame sheet metal 13 has a maintenance opening 13*a* formed in a rectangular shape elongated in a right-and-left direction. The maintenance opening 13*a* is formed at a location corresponding to the conveyance unit 20 as viewed from the front.

Figure 3:
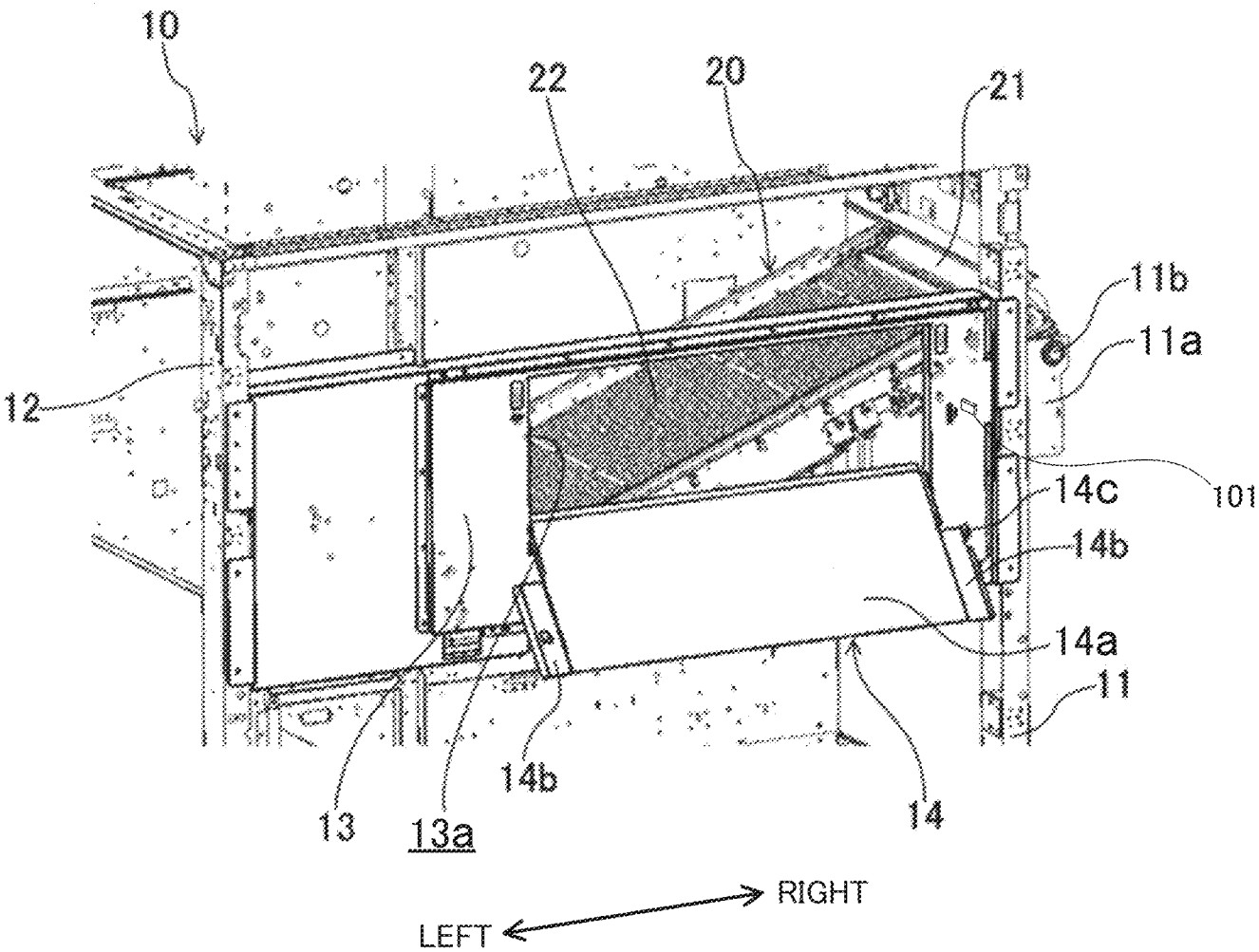
FIG. 3 is a perspective view showing an appearance of the intermediary conveyance device from which the exterior cover is removed and shows a state where the access cover is open.

The maintenance opening 13*a* is covered in an openable and closable manner by an access cover 14. The access cover 14 has shafts provided at respective lower ends of both right and left end surfaces thereof and is designed to be pivotally movable about the shafts serving as a fulcrum. The axis of the shafts of the access cover 14 extends in parallel with a lower edge of the maintenance opening 13*a*. The access cover 14 includes: a cover body 14*a* having a rectangular plate-like shape extending in the right-and-left direction; and stepped rectangular handles 14*b* connected to respective upper end portions of both right and left edges of the cover body 14*a*. An operator can perform the work of opening and closing the access cover 14 by holding the handles 14*b*. For example, in opening the access cover 14 being in a closed position (the position shown in FIG. 2), the operator holds the handles 14*b* and pulls the access cover 14. Thus, as shown in FIG. 3, the access cover 14 pivots down forwardly about the shafts as a fulcrum located at the lower end thereof and, thus, the maintenance opening 13*a* opens. The operator can perform, through the open maintenance opening 13*a*, various works, such as the work of removing a sheet jammed in the conveyance path on the conveyance unit 20.

The conveyance unit 20 includes: a pair of rollers 21 disposed apart from each other in the right-and-left direction; and an endless conveying belt 22 looped around the pair of rollers 21. The upper surface of the conveying belt 22 functions as a conveyance surface on which a sheet is to be conveyed.

As shown in FIG. 1, a right end portion of the conveyance unit 20 is pivotally movably supported by a shaft member 11*b* mounted to both the right post members 11. The shaft member 11*b* extends in a front-to-rear direction. Both ends of the shaft member 11*b* are supported by a pair of front and rear bracket plates 11*a* (see FIGS. 2 and 3) extended from respective side surfaces of the right post members 11.

Furthermore, the conveyance unit 20 is designed to be pivotally movable between a conveyance position (the position shown by the solid line in FIG. 1) where the upper surface of the conveying belt 22 is horizontally oriented to make a sheet conveyable and a maintenance position (the position shown by the dash-double-dot-line in FIG. 1) tilted down at a predetermined angle from the conveyance position with the shaft member 11*b* as a fulcrum. This position switching of the conveyance unit 20 is implemented by a drive motor under the instruction of an unshown control device.

For example, when receiving an operation signal indicating that an operator is about to do dejamming work from an operating panel disposed on the top surface of the image forming apparatus 1, the control device activates the drive motor to move the conveyance unit 20 from the conveyance position to the maintenance position. On the other hand, when receiving from the operating panel an end-of-operation signal indicating that the dejamming work is completed, the control device moves the conveyance unit 20 from the maintenance position to the conveyance position.

[Specific Structure of Locking Mechanism]

Figure 4:
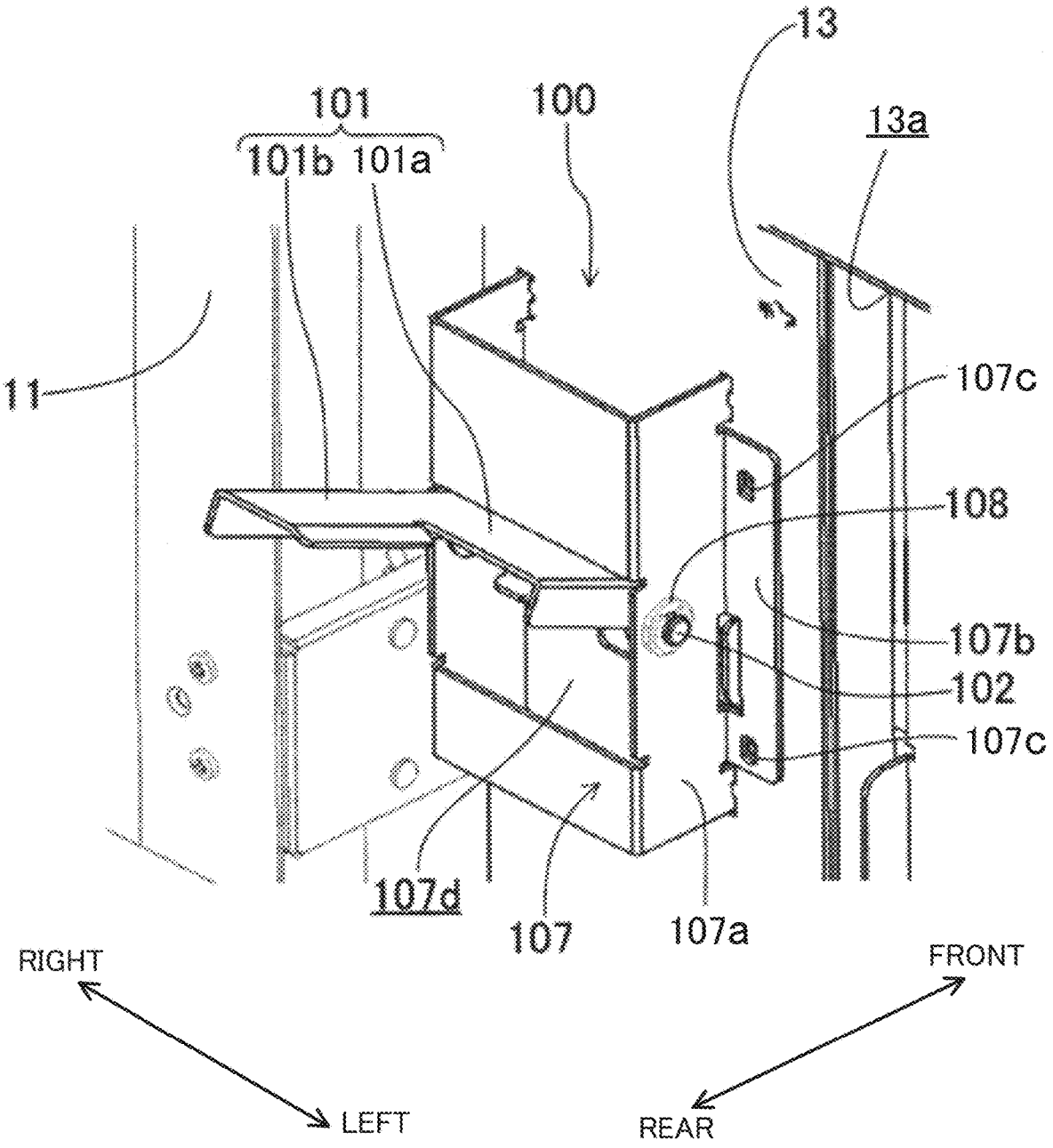
FIG. 4 is a perspective view showing an appearance of a locking mechanism attached to an inner wall surface of a front frame sheet metal.

As shown in FIG. 4, a locking mechanism 100 is mounted to a right end portion of the back surface of the front frame sheet metal 13.

In this embodiment, the intermediary conveyance device 3 further includes the locking mechanism 100 for the purpose of preventing the access cover 14 from opening while the conveyance unit 20 is running.

The locking mechanism 100 is designed to lock the access cover 14 during the conveyance unit 20 being in the conveyance position, and unlock the access cover 14 in conjunction with the transition movement of the conveyance unit 20 from the conveyance position to the maintenance position. Furthermore, the locking mechanism 100 includes a mechanism capable of unlocking the access cover 14 by a manual operation of the operator.

Figure 5:
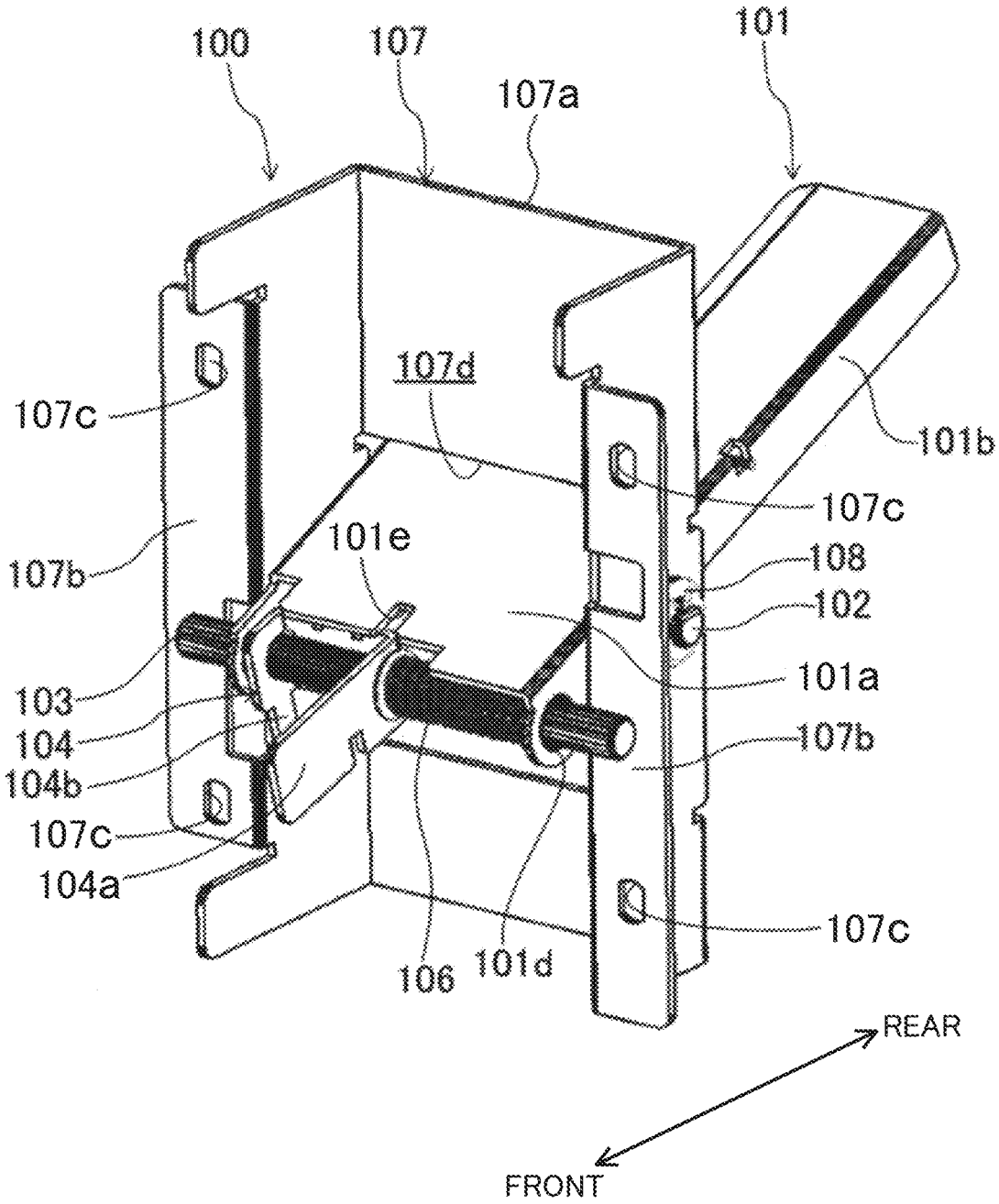
FIG. 5 is a perspective view showing the locking mechanism as viewed from the right front quarter thereof.
Figure 6:
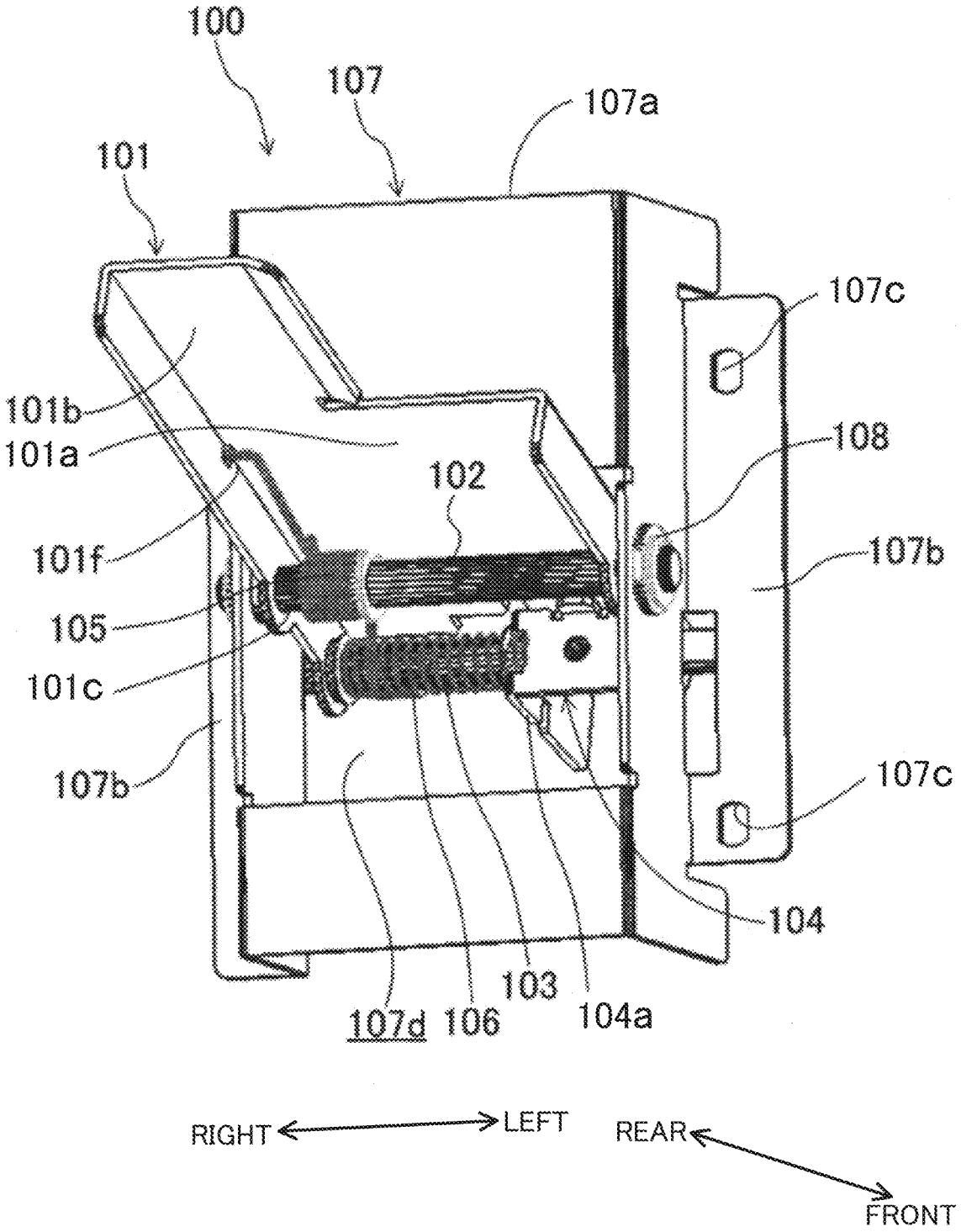
FIG. 6 is a perspective view showing the locking mechanism as viewed from the left rear quarter thereof.
Figure 7:
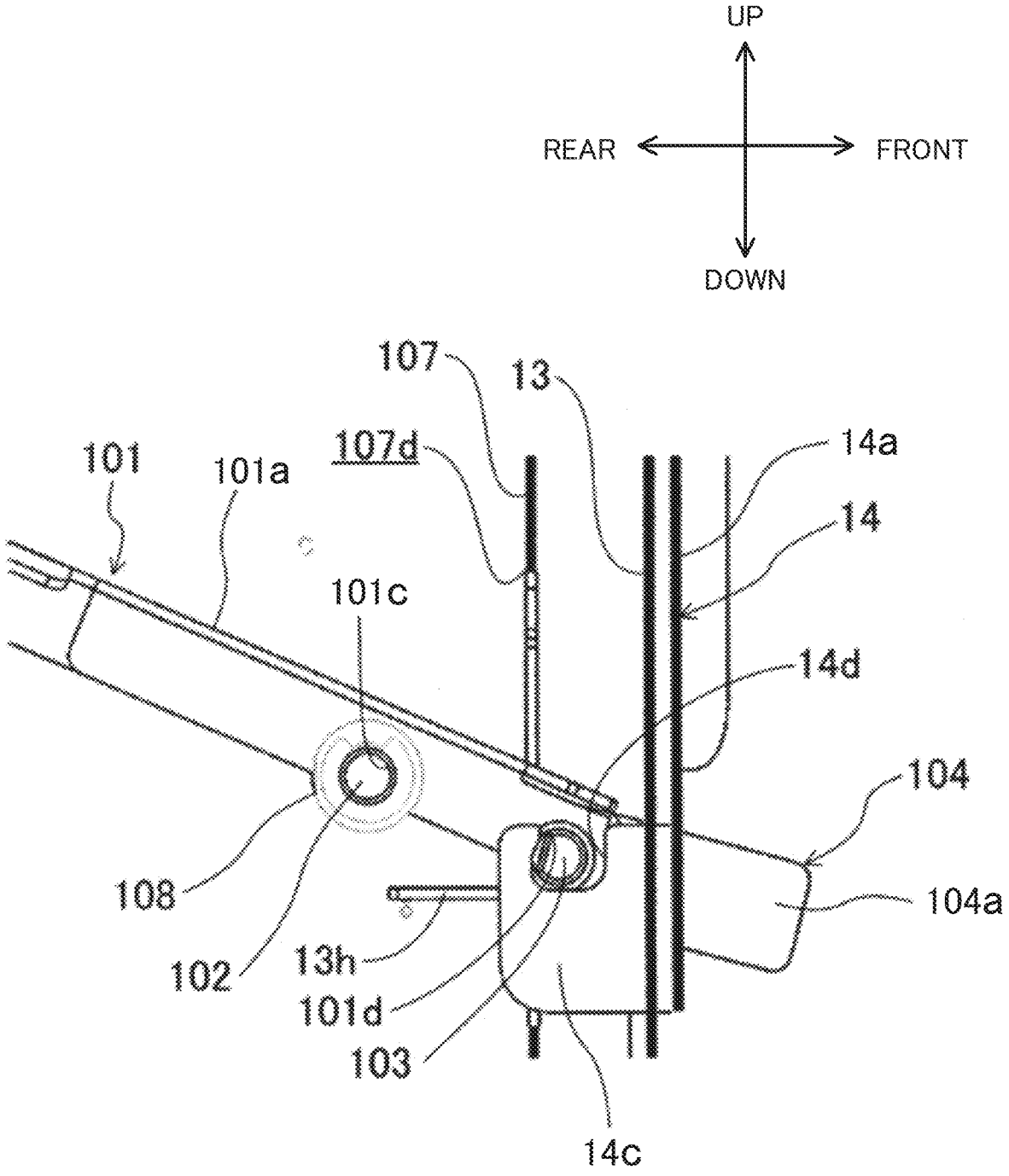
FIG. 7 is a side view showing the locking mechanism as viewed from the left thereof and shows a state where a conveyance unit is in a conveyance position and the access cover is locked.

As shown in FIGS. 5 to 7, the locking mechanism 100 includes: a cooperating lever 101 operatively associated with up-and-down movement of the conveyance unit 20; a supporting shaft 102 supporting the cooperating lever 101 to allow pivotal movement of the cooperating lever 101; a locking shaft 103 pivotally attached to an end of the cooperating lever 101; an operating member 104 coupled to the locking shaft 103; a torsion spring 105 (see FIG. 6) biasing the cooperating lever 101 pivotally about the supporting shaft 102; a compression coil spring 106 biasing the operating member 104; and a support case 107.

The cooperating lever 101 is formed of a sheet-metal member that has a root end facing the maintenance opening 13*a* and a distal end located opposite to the maintenance opening 13*a* and has an approximately L-shape in plan view. The cooperating lever 101 includes: a basal portion 101*a* disposed with its widthwise direction oriented along the right-and-left direction and having a downwardly open, inverted U-shaped cross section; and an extension 101*b* extending from a distal end of the basal portion 101*a*. The extension 101*b* has a smaller width than the basal portion 101*a*. Right and left side walls of the basal portion 101*a* are provided, at their intermediate portions in the front-to-rear direction, with respective through holes 101*c* formed to allow the supporting shaft 102 to pass through them. The right and left side walls of the basal portion 101*a* are also provided at their root end portions with respective through holes 101*d* formed to allow the locking shaft 103 to pass through them. An escape slit 101*e* is formed at a root edge of the basal portion 101*a*.

The supporting shaft 102 is formed of a round bar member extending in the right-and-left direction and fixed at both ends against axial movement to the support case 107 with retaining rings 108.

The support case 107 is composed of: a main case portion 107*a* having a forwardly open, overturned U-shaped cross section and extending in a vertical direction; and respective mounting plate portions 107*b* connected to both right and left edges of the main case portion 107*a* and extending in the vertical direction. Each mounting plate portion 107*b* of the support case 107 has two mounting holes 107*c* formed therein for use in screwing the support case 107 to the front frame sheet metal 13. The supporting shaft 102 is disposed to span the right and left side walls of the main case portion 107*a*. A rectangular opening 107*d* is formed in a vertically intermediate portion of the main case portion 107*a*. The cooperating lever 101 passes through the opening 107*d* and its distal end extends to below the conveyance unit 20.

A torsion spring 105 is disposed about a right end portion of the supporting shaft 102. One end of the torsion spring 105 is anchored to a horizontal extension 13*h* (see FIG. 7) extending horizontally rearward from the back surface of the front frame sheet metal 13. The other end of the torsion spring 105 is fixedly engaged in an engaging hole 101*f* (see FIG. 6) formed in the cooperating lever 101. In addition, the torsion spring 105 biases the cooperating lever 101 in a direction where the distal end of the cooperating lever 101 moves up and the root end thereof moves down (i.e., clockwise in FIG. 7).

The locking shaft 103 is formed of a round bar member that passes through the through holes 101*d* formed in the root end portion of the cooperating lever 101 and extends in the right-and-left direction. The operating member 104 is mounted on an axially intermediate portion of the locking shaft 103. The compression coil spring 106 is disposed in a compressed state between the operating member 104 and the left side wall of the basal portion 101*a* of the cooperating lever 101. Thus, the compression coil spring 106 biases the operating member 104 to the left.

The operating member 104 (see FIG. 6) is fastened to the locking shaft 103 by a screw. The locking shaft 103 and the operating member 104 are always pressed to the left by a biasing force of the compression coil spring 106.

The operating member 104 is formed, for example, by bending a sheet-metal member in an overturned U-shape. One of both lateral end plate portions of the operating member 104 is formed longer than the other lateral end plate portion to form a holding plate portion 104*a*. The other lateral end plate portion of the operating member 104 is connected to a stopper plate 104*b* extending in a rectangular shape as viewed in a thickness direction.

Figure 8:
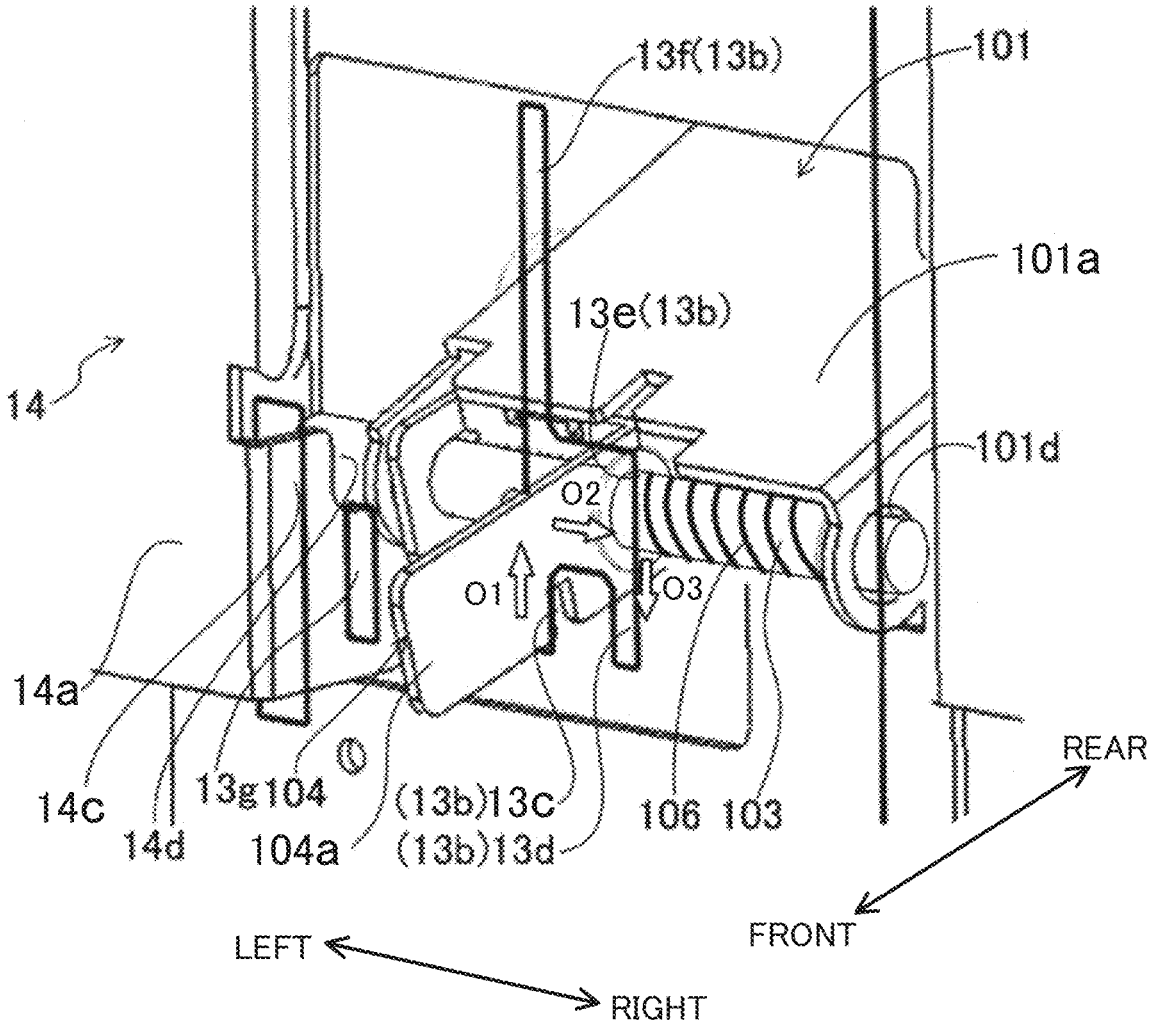
FIG. 8 is a perspective view of an appearance of the locking mechanism being in a state shown in FIG. 7 as viewed from the right front quarter thereof.

As shown in FIG. 8, the holding plate portion 104*a* (an example of the holding portion) of the operating member 104 passes through a lever through hole 13*b* formed in the front frame sheet metal 13 and extends ahead of the front of the housing. By removing a front exterior cover (not shown) of the housing, the operator can hold with a hand the holding plate portion 104*a* extending ahead of the front of the housing. The lever through hole 13*b* is formed in the front frame sheet metal 13 provided with the access cover 14 and forming part of the housing of the intermediary conveyance device 3. For the sake of clarifying the structure in the interior of the housing, FIG. 8 shows the interior of the housing that should normally be hidden by the front frame sheet metal 13.

The lever through hole 13*b* is constituted by a first lower end slot 13*c*, a second lower end slot 13*d*, a rectangular hole 13*e*, and an upward slot 13*f* The rectangular hole 13*e* has a rectangular shape extending in the right-and-left direction. The first lower end slot 13*c* and the second lower end slot 13*d* are formed into slits extending downwardly from both lateral ends of the lower edge of the rectangular hole 13*e*. The upward slot 13*f* extends upwardly from the left end of the upper edge of the rectangular hole 13*e* and is located on the same line as the first lower end slot 13*c* with the rectangular hole 13*e* in between when viewed from the front.

The front frame sheet metal 13 further has a slit-shaped through hole 13*g* which is formed therein to the left of the lever through hole 13*b* and through which a locking plate portion 14*c* formed on the access cover 14 passes.

The locking plate portion 14*c* is a vertical plate portion connected to the inner wall surface of the cover body 14*a* of the access cover 14. The locking plate portion 14*c* has an upwardly open, rectangular locking groove 14*d* formed at the upper end thereof. When the locking shaft 103 engages in the locking groove 14*d* of the locking plate portion 14*c*, the access cover 14 is locked against opening. When the locking shaft 103 escapes out of the locking groove 14*d*, the access cover 14 is unlocked.

[Explanation of Operation of Locking Mechanism]

A description will be given of the operation of the locking mechanism 100 with reference to FIGS. 7 to 10.

FIGS. 7 and 8 show an operating state of the locking mechanism 100 when the conveyance unit 20 of the intermediary conveyance device 3 is in the conveyance position. As shown in these figures, when the conveyance unit 20 is in the conveyance position, the cooperating lever 101 is biased clockwise in FIG. 7 by the torsion spring 105 (not shown in FIG. 7). Therefore, the locking shaft 103 attached to the root end of the cooperating lever 101 moves to a locking position and engages in the locking groove 14*d* of the access cover 14. Thus, the access cover 14 is locked against opening forward.

Figure 9:
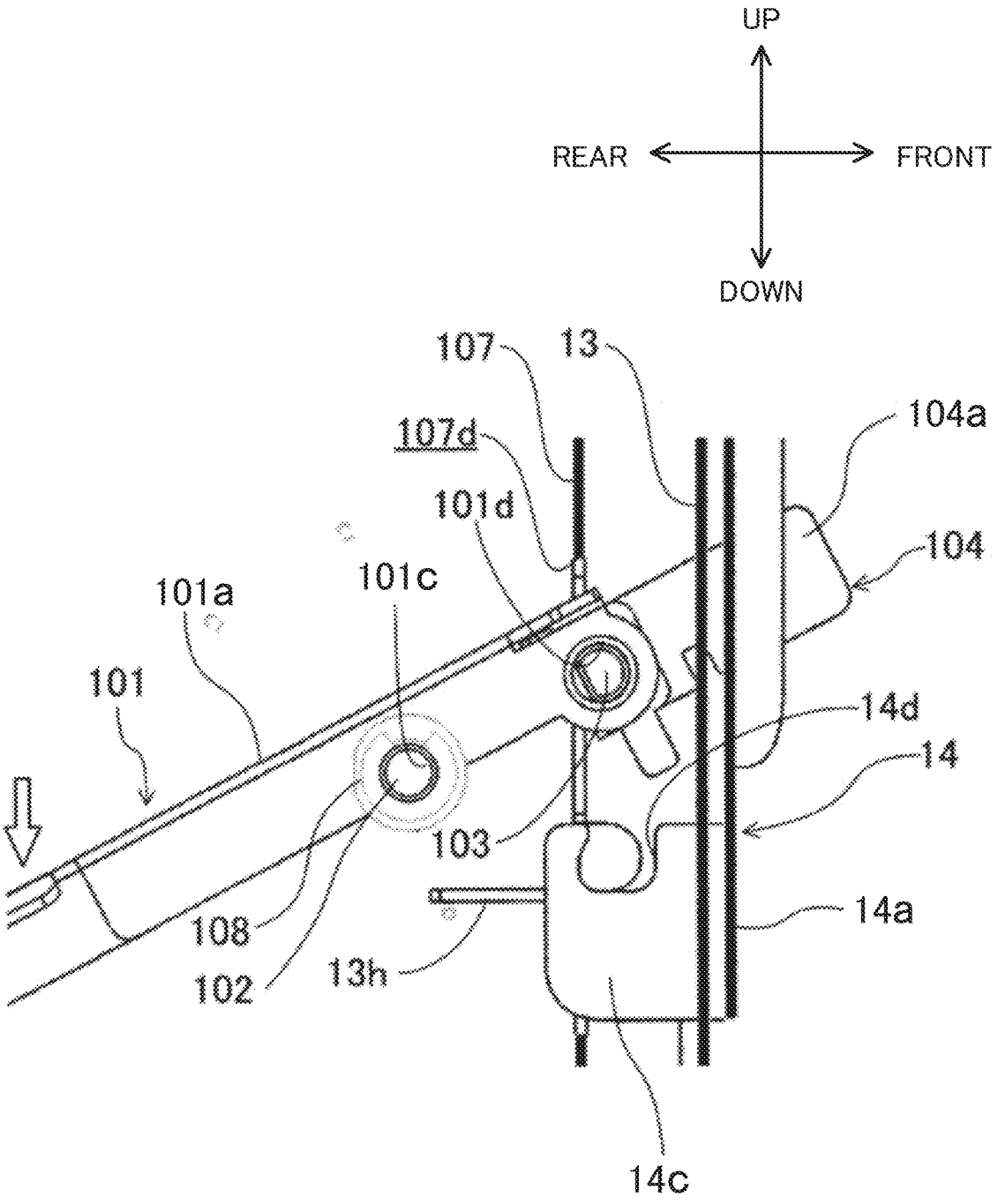
FIG. 9 is a side view showing the locking mechanism as viewed from the left thereof and shows a state where the conveyance unit moves down to a maintenance position and the access cover is unlocked.

When in this state the operator performs, through the operating panel (for example, a liquid-crystal touch panel) of the image formation system A, an operation for moving the conveyance unit 20 to the maintenance position, the control device having received an operation signal indicating the operation activates the drive motor for the conveyance unit 20. As a result, the conveyance unit 20 pivotally moves down from the conveyance position to the maintenance position (the position shown by the dash-double-dot-line in FIG. 1). In addition, in the course of the downward movement of the conveyance unit 20, the extension 101*b* of the cooperating lever 101 is pressed downwardly by the conveyance unit 20 and, thus, the cooperating lever 101 pivotally moves about the supporting shaft 102 in the direction where its distal end moves down and its root end moves up. As a result, as shown in FIG. 9, the locking shaft 103 provided at the root end of the cooperating lever 101 moves to a position (a first unlocking position) located upwardly of the locking groove 14*d* of the access cover 14, resulting in disengagement of the locking shaft 103 from the locking groove 14*d*. Thus, the access cover 14 is unlocked and becomes openable forward. Thereafter, when the maintenance work is completed and the operator performs an end-of-maintenance operation through the operating panel, the conveyance unit 20 is moved back to the conveyance position by the drive motor. When the conveyance unit 20 is moved back to the conveyance position, the cooperating lever 101 is pivotally moved clockwise in FIG. 9 by the biasing force of the torsion spring 105. As a result, the locking shaft 103 attached to the root end of the cooperating lever 101 engages again in the locking groove 14*d* of the access cover 14 and, thus, the access cover 14 is locked against opening.

As just described, when the conveyance unit 20 is in the conveyance position, the access cover 14 is basically locked against opening by the locking mechanism 100. However, in this embodiment, as will be described below, even when the conveyance unit 20 is in the conveyance position, the operator can unlock the access cover 14 to make the access cover 14 openable by moving the holding plate portion 104*a* of the operating member 104.

The arrows O1 to O3 in FIG. 8 show an operating procedure of the holding plate portion 104*a*. First, in a state where the conveyance unit 20 is in the conveyance position, the operator pulls up with fingers the holding plate portion 104*a* located in the first lower end slot 13*c* (see the arrow O1). Then, the operator slides the pulled-up holding plate portion 104*a* to the right along the rectangular hole 13*e* (see the arrow O2) and then pushes it down to engage it in the second lower end slot 13*d* (see the arrow O3).

In this relation, since the operating member 104, inclusive the holding plate portion 104*a*, and the locking shaft 103 are connected in an integrally freely rotatable manner to the cooperating lever 101, no change is caused by the pull-up operation (the operation shown by the arrow O1) and the push-down operation (the operation shown by the arrow O3) of the holding plate portion 104*a*.

Figure 10:
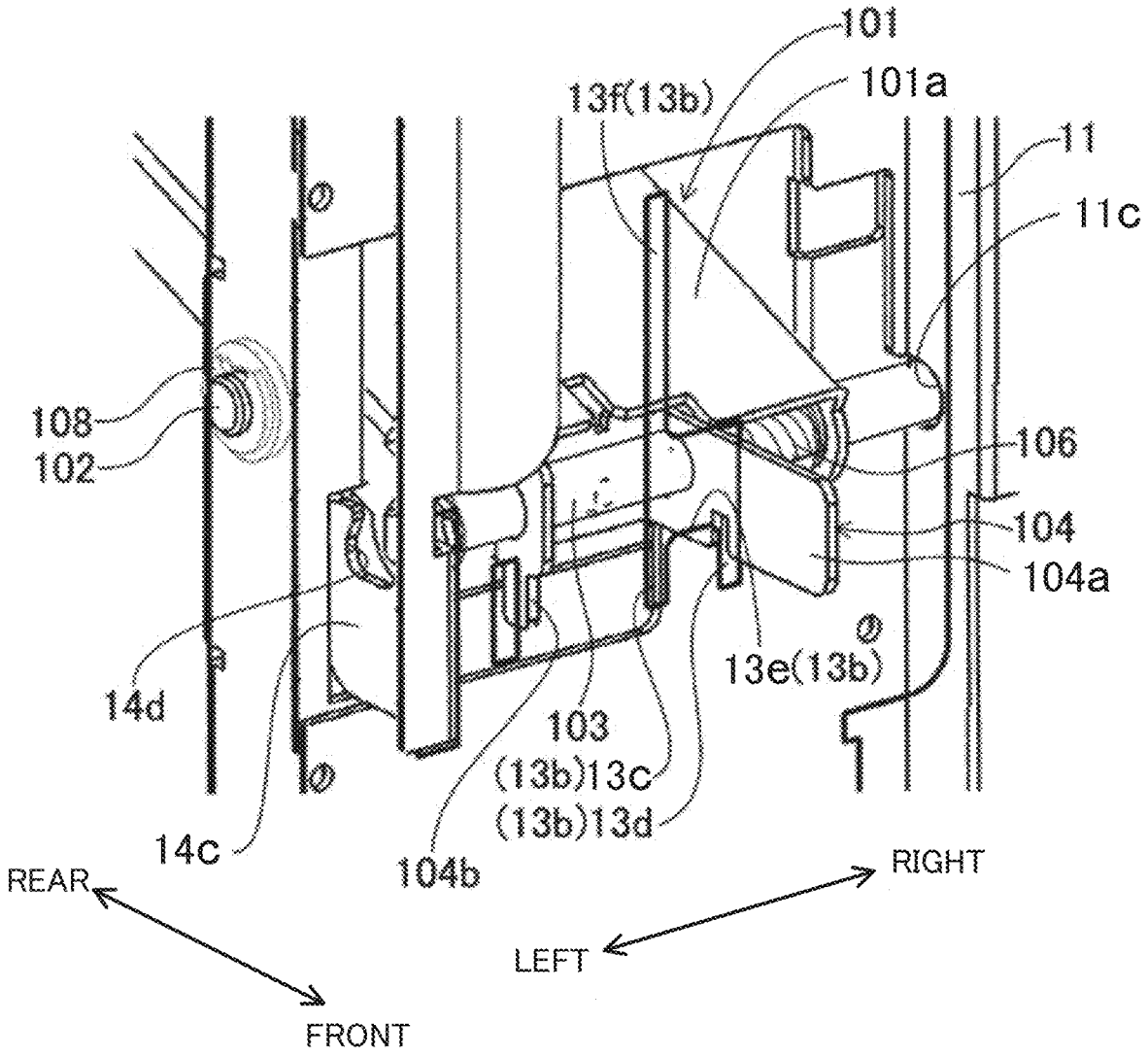
FIG. 10 is a perspective view of an appearance of the locking mechanism being in a state shown in FIG. 7 as viewed from the left front quarter thereof.

However, since the operating member 104 is fixed to the locking shaft 103, the operation of sliding the holding plate portion 104*a* of the operating member 104 to the right (the operation shown by the arrow O2) causes the locking shaft 103 to be thrust to the right by the operating member 104. Thus, as shown in FIG. 10, the locking shaft 103 moves to a position (a second unlocking position) located rightward of the locking groove 14*d* of the access cover 14, so that the right end portion of the locking shaft 103 engages in a locking hole 11*c* (an example of the engaged portion) formed in the post member 11 of the framing 10. The lever through hole 13 including the first lower end slot 13*c*, the rectangular hole 13*e*, and the second lower end slot 13*d* receives the operating member 104 passing therethrough and guides the path of movement of the operating member 104 in allowing the operating member 104 to move the locking shaft 103 from the locking position to the second unlocking position. For the sake of clarifying the structure in the interior of the housing, FIG. 10 shows the interior of the housing that should normally be hidden by the front frame sheet metal 13.

As a result, the access cover 14 is unlocked and the cooperating lever 101 is, in a state shown in FIG. 7, constrained against pivotal movement about the supporting shaft 102 by the locking shaft 103. Therefore, even if in this state the conveyance unit 20 accidentally moves down, the cooperating lever 101 remains stationary without pivotally moving and supports the conveyance unit 20 from below. Hence, the operator can safely perform the maintenance work for components under the conveyance unit 20, the work of looking at the underside of the conveyance unit 20, or like works.

Figure 11:
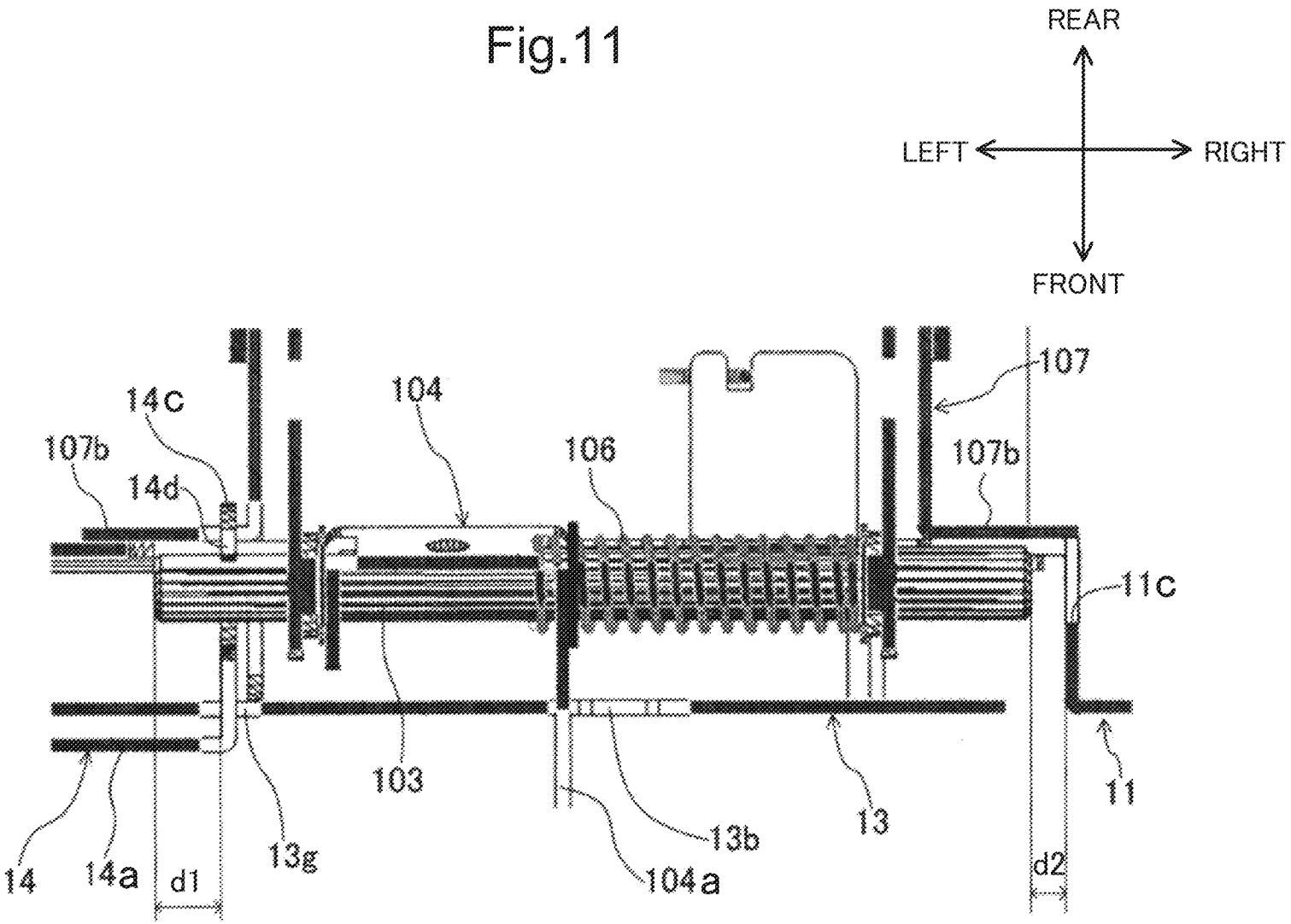
FIG. 11 is a plan view of the locking mechanism being in a state shown in FIG. 7 as viewed from the top thereof.

Referring to FIG. 11, if, in performing the operation for sliding the holding plate portion 104*a* to the right (the operation shown by the arrow O2), the timing for the locking shaft 103 to escape out of the locking groove 14*d* of the access cover 14 is too early, the locking shaft 103 may escape out of the locking groove 14*d* of the access cover 14 before being inserted into the locking hole 11*c* of the right post member 11.

To cope with the above situation, in this embodiment, as shown in FIG. 11, in a state before the locking shaft 103 is slid to the right (i.e., a state where the holding plate portion 104*a* engages in the first lower end slot 13*c*), the distance d1 between the outside end surface of the locking groove 14*d* in the direction of slide of the locking shaft 103 and the proximal end surface of the locking shaft 103 is set larger than the distance d2 from the opposite end surface of the locking shaft 103 to the entrance of the locking hole 11*c*. Thus, the locking shaft 103 can be prevented from escaping out of the locking groove 14*d* of the access cover 14 before being inserted (engaged) into the locking hole 11*c*. Hence, after the pivotal movement of the cooperating lever 101 about the supporting shaft 102 is securely constrained by the locking shaft 103, the access cover 14 can be unlocked, which increases the safety of the operator as much as possible.

It is conceivable that there may be some operators who perform the handling of forcibly moving the locking shaft 103 out of the locking groove 14*d* of the access cover 14, i.e., a so-called incorrect handling. Possible examples of the incorrect handling are the following two handlings.

Figure 12:
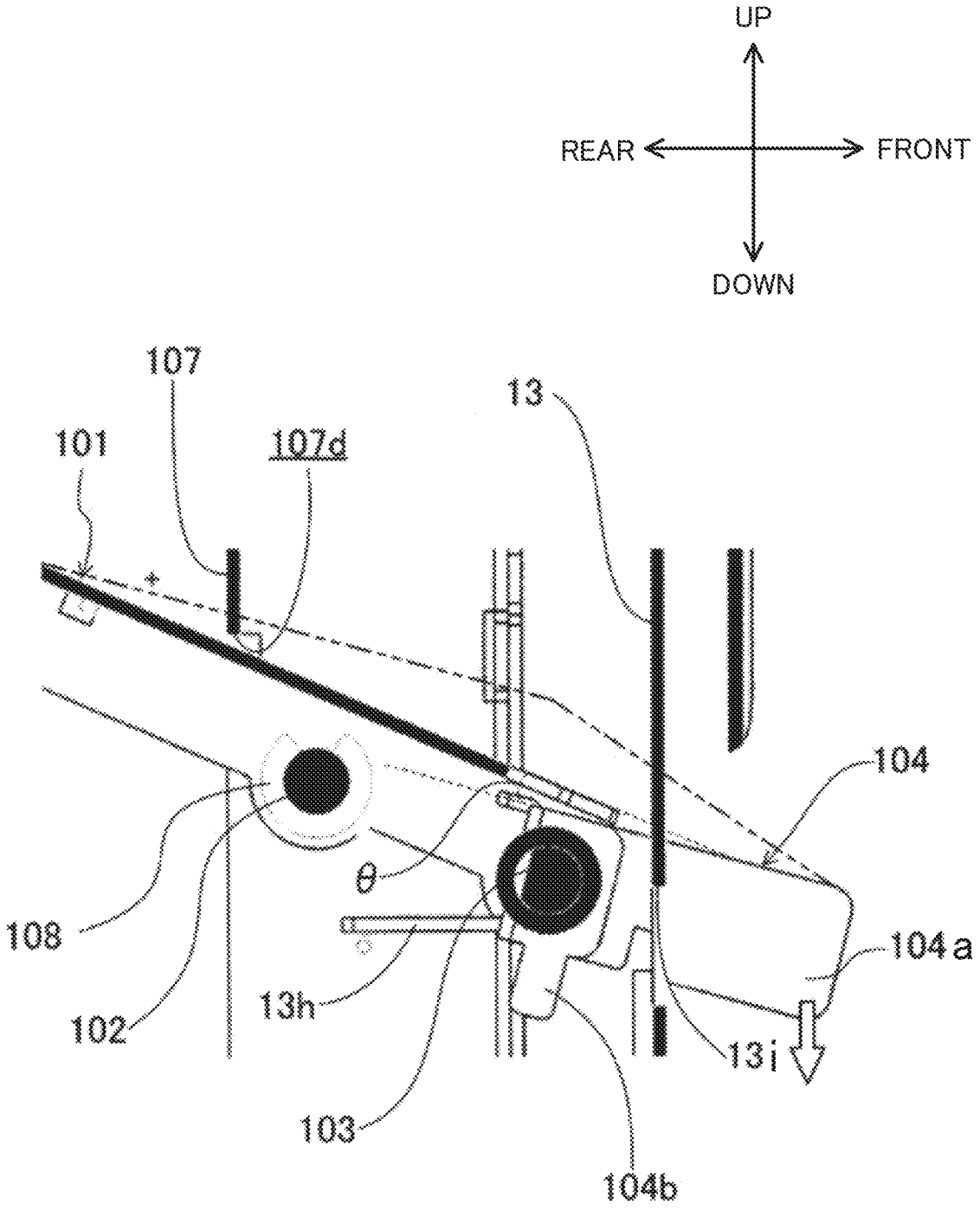
FIG. 12 is a view showing a structure for preventing a first incorrect handling and corresponding to FIG. 7.

A first possible incorrect handling is the handling of forcibly pushing down the holding plate portion 104*a* as shown by the unfilled arrow in FIG. 12. If this handling is performed, the lower edge of the holding plate portion 104 abuts against the lower edge of the lever through hole 13*b*, which causes an upward displacement of the locking shaft 103 by the principle of leverage. At this time, as shown by the dash-double-dot-line in FIG. 12, the upper surface of the cooperating lever 101 and the upper surface of the holding plate portion 104*a* intersect to form a convex-upward, inverted V-shape as viewed in the axial direction of the locking shaft 103. If this situation occurs, the locking shaft 103 escapes upwardly out of the locking groove 14*d* of the access cover 14, so that the access cover 14 is unlocked.

In this embodiment, in order to prevent the access cover 14 from being unlocked by the first incorrect handling, the upper surface of the locking shaft 103 and the upper surface of the holding plate portion 104*a* are previously intersected at an angle θ to form a convex-downward, V-shape. In other words, the operating member 104 is coupled to the locking shaft 103 so that the upper end surface of the holding plate portion 104*a* is at an angle closer to the horizontal than an angle parallel to the upper surface of the cooperating lever 101. Thus, even if the first incorrect handling is performed, the locking shaft 103 is difficult to move upwardly. Hence, it can be surely prevented that the access cover 14 is unlocked by the first incorrect handling.

Figure 13:
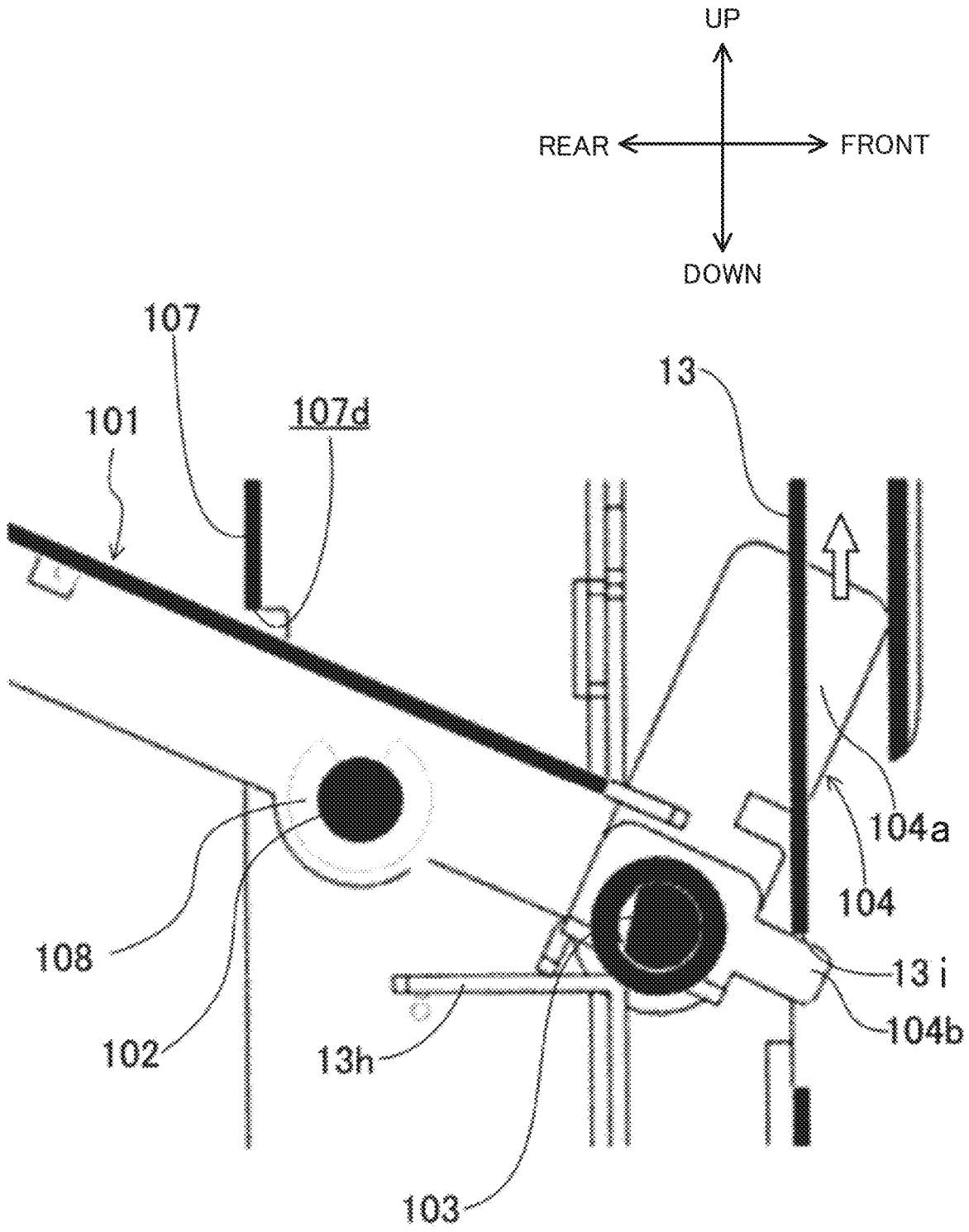
FIG. 13 is a view showing a structure for preventing a second incorrect handling and corresponding to FIG. 7.

A second possible incorrect handling is the handling of pivotally moving the holding plate portion 104*a* about the axis of the locking shaft 103 to lift it as shown by the unfilled arrow in FIG. 13. If this second incorrect handling is performed, the locking shaft 103 is lifted together with the operating member 104 and thus may escape upwardly out of the locking groove 14*d*.

In this embodiment, in order to prevent the access cover 14 from being unlocked by the second incorrect handling, a stopper hole 13*i* is formed in the front frame sheet metal 13 so that when the operating member 104 pivotally moves upwardly to a predetermined angle, the stopper plate 104*b* of the operating member 104 abuts on the upper end (corresponding to the abutment portion) of the stopper hole 13*i*. The abutment of the stopper plate 104*b* on the upper end of the stopper hole 13*i* blocks further upward movement of the operating member 104. Hence, it can be prevented that the locking shaft 103 is escaped out of the locking groove 14*d* by the second incorrect handling and that thus the access cover 14 is unlocked.

A general image forming apparatus, an intermediary device for conveying a sheet discharged from the image forming apparatus to a post-processing device, or like device includes a housing and a conveyance unit contained in the housing. A side wall of the housing has an opening formed for access to the interior of the housing in performing dejamming or other works and the opening is provided with an access cover. If a locking mechanism capable of simply locking and unlocking an object to be locked is applied to this access cover, the locking mechanism can freely manually unlock the access cover even when the conveyance unit is in a conveyance position, which is undesirable because it may interfere with the operation of the apparatus.

As a solution to the above problem, it is conceivable to use a locking mechanism designed to lock the access cover during the conveyance unit being in the conveyance position and unlock the access cover upon movement of the conveyance unit to the maintenance position.

However, in this case, the access cover cannot be unlocked unless the conveyance unit moves to the maintenance position. This presents a problem that when the conveyance unit is in the conveyance position, the operator cannot perform the work of taking out components mounted under the conveyance unit or the work of looking at the conveyance unit from below for the purpose of checking for any failure.

To eliminate the above problem, it is conceivable to make the access cover freely unlockable, for example, by a manual operation. However, in this case, in order to avoid accidental downward movement of the conveyance unit while the operator performs the above works during the conveyance unit being in the conveyance position, it is necessary to provide various sensors and electric safety devices, which invites a cost rise.

In contrast, in the above embodiment, when the conveyance unit 20 is in the conveyance position, the access cover 14 can be easily unlocked and concurrently the conveyance unit 20 can be prevented from unintentionally moving down to the maintenance position.

Other Embodiments

Although the description of the above embodiment has been given of the intermediary conveyance device 3 as an example of the conveyance device, the present disclosure is not limited to such an intermediary conveyance device. For example, the conveyance device may be mounted in the image forming apparatus 1 or in the sheet feeder 2.

Although the description of the above embodiment has been given of the case where the access cover 14 to be locked is provided on the front frame sheet metal 13 located inside of the exterior cover, the present disclosure is not limited to this case. The access cover 14 to be locked may be provided, for example, on the exterior cover.

Although in the above embodiment the access cover 14 is designed to pivotally move up and down about the horizontally extending axis, the present disclosure is not limited to this structure. For example, the access cover 14 may be designed to pivotally horizontally move about a vertical axis.

Although in the above embodiment the locking hole 11*c* is formed in the right post member 11 (part of the housing), the present disclosure is not limited to this structure. In other words, the locking hole 11*c* may not necessarily be formed directly in the housing and, for example, may be formed in any other fixed member coupled to the housing.

INDUSTRIAL APPLICABILITY

As seen from the above, the present disclosure is useful for a conveyance device and useful particularly when applied to a printer, a facsimile machine, a copier, a multifunction peripheral (MFP), a post-processing device or an intermediary conveyance device.

While the present disclosure has been described in detail with reference to the embodiments thereof, it would be apparent to those skilled in the art the various changes and modifications may be made therein within the scope defined by the appended claims.

What is claimed is:

1. A conveyance device comprising:

a conveyance unit pivotally movable up and down about a horizontal axis and movable between a conveyance position where a sheet is horizontally conveyable and a maintenance position a predetermined amount pivotally moved down about the horizontal axis from the conveyance position;

a housing that contains the conveyance unit and has a maintenance opening which is formed in a side surface and through which the conveyance unit is accessible;

an access cover pivotally movable about a predetermined axis along an edge of the maintenance opening; and a locking mechanism that locks the access cover against opening and closing movement during the conveyance unit being in the conveyance position and unlocks the access cover upon pivotal movement of the conveyance unit from the conveyance position to the maintenance position, wherein the locking mechanism comprises:

a locking groove provided at an inner wall surface of the access cover;

a cooperating lever having a root end facing the maintenance opening and a distal end located opposite to the maintenance opening;

a lever supporting shaft that extends in parallel with the predetermined axis and supports an intermediate portion of the cooperating lever located between the root end and the distal end of the cooperating lever to allow pivotal movement of the intermediate portion;

a locking shaft that is attached to the root end of the cooperating lever and extends in parallel with an inner surface of the access cover being in a closed position; and a biasing member that biases the cooperating lever, with the lever supporting shaft as a fulcrum, toward engagement of the locking shaft in the locking groove of the access cover being in the closed position, when the conveyance unit is in the conveyance position, the locking shaft is located in a locking position where the locking shaft engages in the locking groove, when the conveyance unit moves down from the conveyance position to the maintenance position, the distal end of the cooperating lever is pushed down by the conveyance unit to lift the root end of the cooperating lever and, thus, the locking shaft escapes upwardly out of the locking groove and moves to a first unlocking position, the locking shaft is supported by the cooperating lever slidably in an axial direction of the locking shaft between the locking position where the locking shaft engages in the locking groove and a second unlocking position located lateral to the locking groove, when in the second unlocking position, the locking shaft engages with an engaged portion provided at the housing to constrain the cooperating lever against downward movement of the distal end of the cooperating lever, and the conveyance device further comprises an operating member that is coupled to the locking shaft, includes a holding portion capable of being held from outside the housing, and is capable of moving the locking shaft through the holding portion between the locking position and the second unlocking position.

2. The conveyance device according to claim 1, wherein the locking mechanism is designed so that in moving the locking shaft from the locking position to the second unlocking position, the locking shaft engages in the engaged portion before the entire locking shaft escapes out of the locking groove.

3. The conveyance device according to claim 1, wherein the operating member is pivotally movably supported by the locking shaft, and the operating member includes a stopper plate that, upon pivotal movement of an end of the holding portion close to a holding position of the holding portion to a position higher than the locking shaft by a predetermined angle, abuts on an abutment portion provided at the housing to restrict further pivotal movement of the holding portion.

4. The conveyance device according to claim 1, wherein the operating member is pivotally movably supported by the locking shaft, and the operating member is coupled to the locking shaft so that an upper surface of the holding portion and an upper surface of the cooperating lever form a concave-downward, V-shape as viewed in an axial direction of the locking shaft.

5. The conveyance device according to claim 1, wherein a lever through hole through which the operating member passes is formed in a front frame sheet metal on which the access cover is provided and which forms part of the housing, and the lever through hole guides a path of movement of the operating member while the operating member moves the locking shaft from the locking position to the second unlocking position.

* * * * *